US006712560B1

(12) United States Patent
Cottrell

(10) Patent No.: US 6,712,560 B1
(45) Date of Patent: Mar. 30, 2004

(54) RISER SUPPORT FOR FLOATING OFFSHORE STRUCTURE

(75) Inventor: Roy H. Cottrell, Cypress, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/068,013

(22) Filed: Feb. 6, 2002

Related U.S. Application Data

(63) Continuation-in-part of application No. 10/017,175, filed on Dec. 7, 2001.
(60) Provisional application No. 60/251,938, filed on Dec. 7, 2000.

(51) Int. Cl.[7] ..... E21B 19/09; E02B 17/00
(52) U.S. Cl. ..... 405/224.4; 405/195.1; 405/211; 405/223.1; 405/224.2; 405/224; 166/350; 166/355; 175/5; 114/264
(58) Field of Search ..... 405/195.1, 211, 405/223.1, 224, 224.1–224.4; 166/350, 355, 341, 352, 367; 175/5–8; 114/264–267

(56) References Cited

U.S. PATENT DOCUMENTS

| | | | | | |
|---|---|---|---|---|---|
| 3,601,075 | A | | 8/1971 | Deslierres | |
| 4,176,986 | A | * | 12/1979 | Taft et al. | 405/211 |
| 4,436,451 | A | * | 3/1984 | Anderson | 405/224.2 |
| 4,606,673 | A | | 8/1986 | Daniell | |
| 4,616,707 | A | * | 10/1986 | Langner | 166/355 |
| 4,702,321 | A | | 10/1987 | Horton | |
| 4,735,267 | A | | 4/1988 | Stevens | |
| 4,913,238 | A | | 4/1990 | Danazcko et al. | |
| 4,966,495 | A | | 10/1990 | Goldman | |
| 5,439,321 | A | * | 8/1995 | Hunter | 405/195.1 |
| 5,479,990 | A | * | 1/1996 | Peppel | 166/350 |
| 5,887,659 | A | * | 3/1999 | Watkins | 166/350 |
| 6,161,620 | A | | 12/2000 | Cox et al. | |
| 6,176,646 | B1 | | 1/2001 | Finn et al. | |
| 6,375,391 | B1 | * | 4/2002 | B.o slashed.rseth et al. | 405/224.4 |
| 6,402,431 | B1 | * | 6/2002 | Nish | 405/224.3 |

FOREIGN PATENT DOCUMENTS

| | | | | |
|---|---|---|---|---|
| FR | 2 574 367 A1 | | 12/1984 | |
| GB | 2147549 | * | 5/1985 | 114/264 |
| GB | 2156401 | * | 10/1995 | 405/195.1 |
| WO | WO 00/58598 A1 | | 10/2000 | |

* cited by examiner

*Primary Examiner*—Jong-Suk (James) Lee
(74) *Attorney, Agent, or Firm*—Gary Bush; Andrews Kurth LLP

(57) ABSTRACT

A floating offshore platform configuration is provided, which decouples pitch, roll, and heave motions from acting on tensioned risers and accommodates the angular displacement induced by floating offshore platform surge and/or sway excursion without inducing bending in the riser at its entrance to the floating offshore platform. The risers are guided by an inner structure that is tethered from the sea floor and centered inside an outer hull structure. Outer hull structure heave, pitch and roll motions are substantially isolated from acting on the inner structure through a connection mechanism, and each riser is allowed to individually expand or contract.

19 Claims, 7 Drawing Sheets

10
120
15
66
2
5
19
55
110
19
42
2
42
75
70
45
60
30
75
3
3
44
52
85
44
50
35
54
46
4
4
86
46
80
80
90
90
100
200

55
17
11
19
11
13
A
45
B
11
13
17
30
11
19
70
11
19
13
11
60
17
45
11
13
19
11
17

FIG. 8
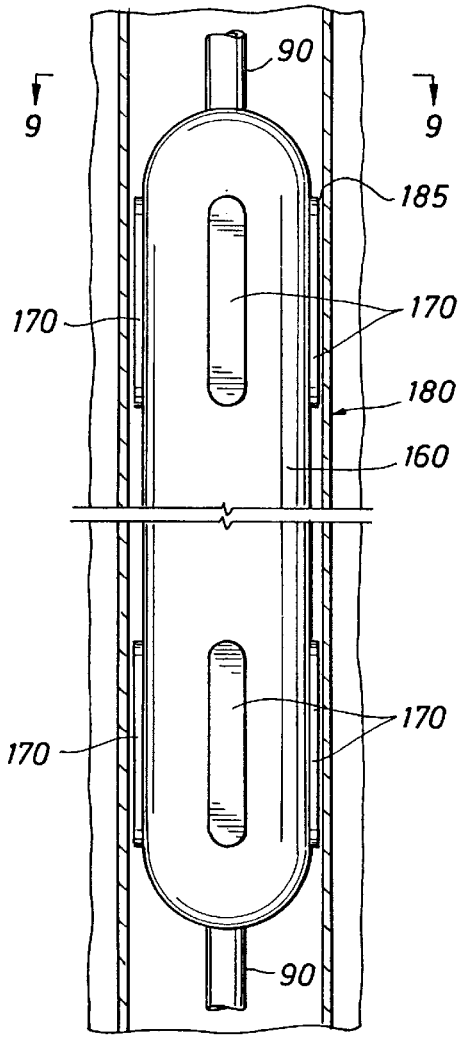
FIG. 10
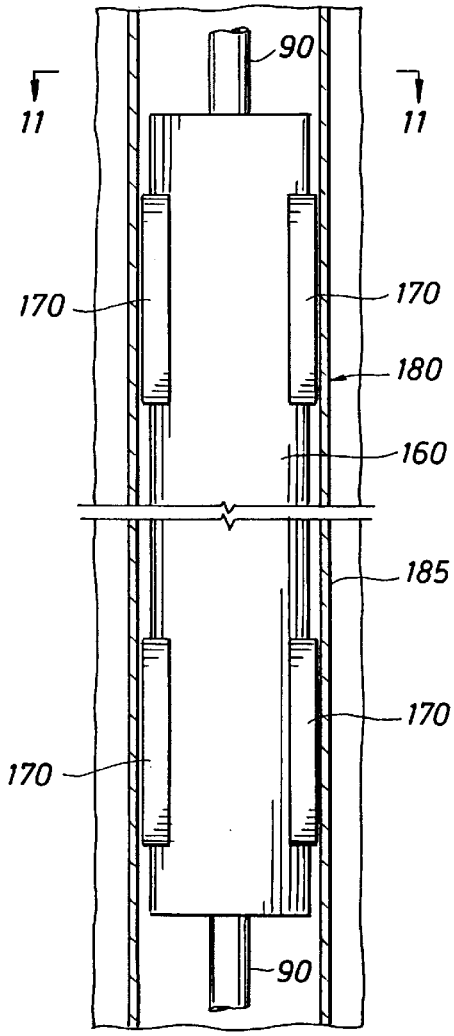
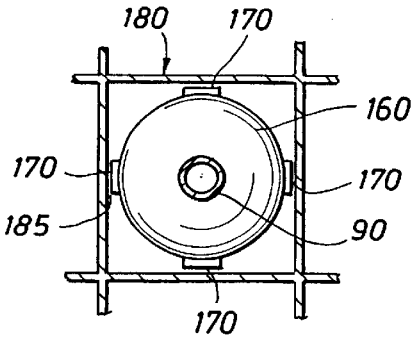
FIG. 9
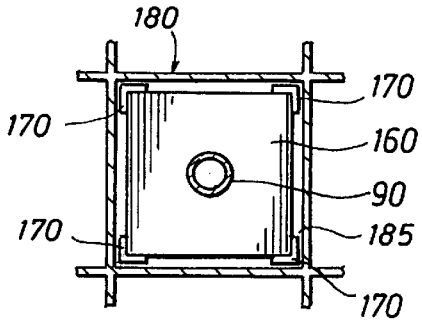
FIG. 11

FIG. 12
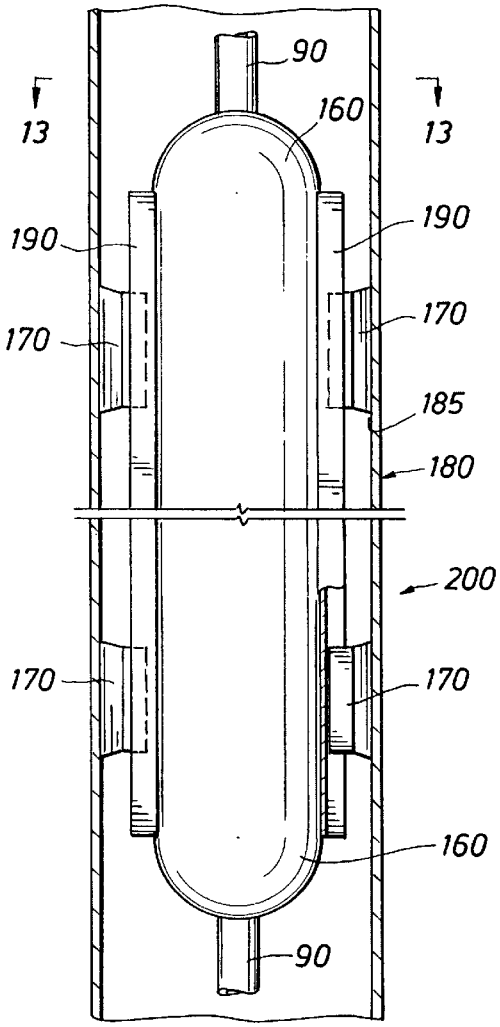
FIG. 14
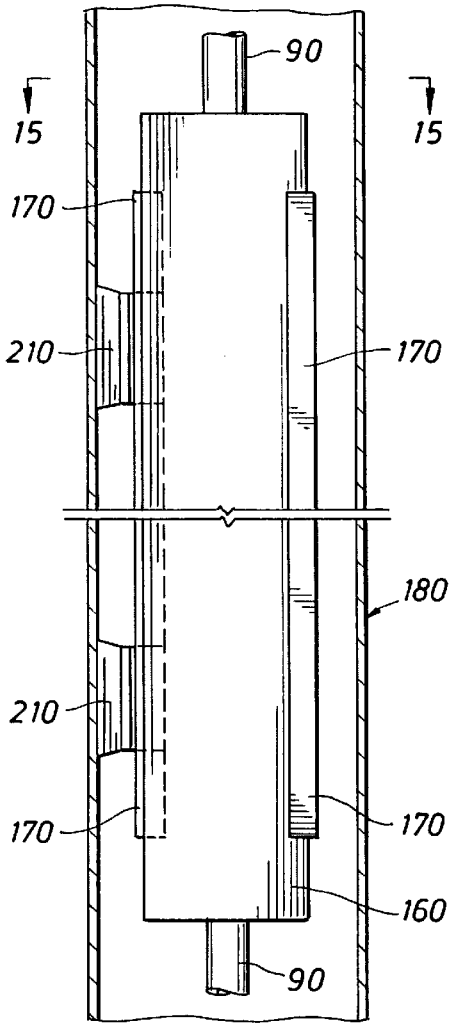
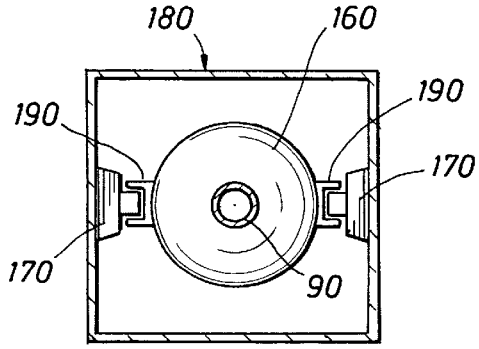
FIG. 13
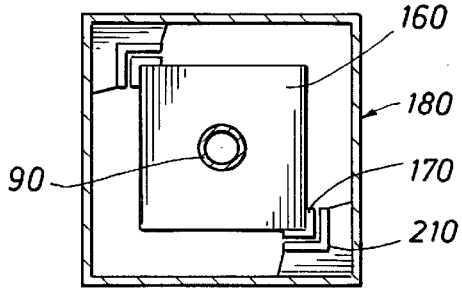
FIG. 15

RISER SUPPORT FOR FLOATING OFFSHORE STRUCTURE

CROSS REFERENCE TO RELATED APPLICATION

This is a Continuation-in-Part Application which claims priority from U.S. patent application Ser. No. 10/017,175 filed on Dec. 7, 2001, which claims priority from U.S. Provisional Application Serial No. 60/251,938, filed on Dec. 7, 2000.

BACKGROUND OF THE INVENTION

1. Field of the Invention

This invention relates generally to an arrangement for an offshore platform for drilling or workover operations, production and/or storage operations and in particular to an arrangement for coupling subsea risers to a floating offshore structure which substantially isolates the structure's heave, pitch, and roll motions from the risers. The term floating offshore structure in this specification includes SPARS, FPSO's, floating offshore drilling platforms and the like.

2. Description of the Prior Art

The prior art has sought arrangements for coupling subsea risers to floating offshore structures. For example, U.S. Pat. No. 4,606,673 discloses a riser support can for a SPAR Buoy where a single buoyant riser support can supports several risers. The SPAR Buoy, a floating deepwater production and oil storage vessel, includes a riser system whereby risers are connected to a riser float chamber that moves along guides within a vertical passageway within the vessel. The riser support includes an adjustable support which repartitions the load on the risers to assume that each riser is uniformly tensioned. Hull heave motion is decoupled from the riser, but pitch and roll motions of the hull are transferred to the risers. As a result, the risers of this configuration are subjected to cyclical bending. Furthermore, as the adjustable riser supports do not provide any capability of axial vertical flexure relative to one another, this arrangement of riser support does not permit individual riser length fluctuations commonly occurring as a result of operating riser temperature and internal pressure changes. The risers supported as shown therein are subject to cyclical variation in tension as well. The vessel does not have a moonpool and is not designed for drilling or extensive workover operations. If drilling equipment is desired on the SPAR Buoy of the U.S. Pat. No. 4,606,673 structure, the draw works of such drilling equipment would be mounted on the surrounding hull and therefore would require heave compensation.

U.S. Pat. No. 4,966,495 discloses a floating drilling and production structure that includes two independently floating bodies. An outer production and drilling semi-submersible vessel completely surrounds an independently floating wellhead support buoy and supports the weight of the drilling platform, machinery, etc. and is ballasted and anchored in a manner similar to a conventional semi-submersible vessel. An inner constant tension buoy supports many risers. Pitching of the outer vessel is decoupled from the single buoy which supports the risers. The inner buoy (or riser can) is centered within the hull by an annular bumper. The risers are attached to the single riser can by lockdown screws. A significant disadvantage of the U.S. Pat. No. 4,966,495 arrangement is that the semi-submersible "outer" vessel has a large waterplane area thereby producing large forces in tension due to wave action and hull extension. Another disadvantage is that the drilling or workover equipment is mounted on the outer vessel which induces bending in the drill pipe when there is relative pitch between the outer body and the inner riser support buoy. Thus, the advantage of decoupling the pitch of outer hull from the inner riser support body can only be accomplished when the drilling rig is not in use. Another disadvantage of the arrangement of U.S. Pat. No. 4,966,495 is that individual riser elongation due to temperature and/or internal pressure variation is not allowed for. Furthermore any pitch of the inner riser support buoy results in fluctuation in riser tension because of the large waterplane area of the inner support buoy.

U.S. Pat. No. 4,913,238 discloses a TLP moored riser support module with a conventionally moored semi-submersible hull. A drilling draw works is located on the semi-submersible hull. A relatively small tension leg platform provides a heave-restrained deck for surface wellhead equipment. The hull is free to pitch, roll and heave independently of the risers. The riser support module, being installed within a semi-submersible is exposed to the environment and suffers loading induced thereby. As the semi-submersible hull heave, pitch and roll motions are decoupled from the motions of the riser support module, and the draw works are installed on the semi-submersible hull, the draw works require heave compensation and riser bending due to semi-submersible hull pitch and roll is inherent with this design.

U.S. Pat. No. 4,735,267 discloses a floatation buoy with ballast for supporting multiple risers. The buoy is arranged to be pulled within a moonpool of a buoyant hull. The buoy allows angular flexing of the risers. Individual riser length adjustment is accounted for by allowing the risers to take a catenary shape. The buoy is rigidly connected to the hull of the production vessel. Hanging the risers from the top of the buoy results in static instability, because as the buoy is pulled into the buoyant hull, it becomes unstable and tends to invert unless the buoy is ballasted to negative buoyancy. Because the floatation buoy is not tethered vertically to the sea floor, it is free to heave with the floating production platform, suffering the motions and loads induced thereby.

International patent publication WO 00/58598 shows a riser guide frame which is retractable in the vertical direction for one or more risers on a semi-submersible production vessel. The guide frame provides lateral support for individual riser support buoys. The arrangement of the WO 00/58598 publication provides for lowering the riser support buoys to a point below the splash zone with only the tops of the risers protruding through the splash zone. The riser frame is not tethered to the sea floor, does not have buoyancy, and is rigidly connected to the semi-submersible hull during operation, so the riser frame induces wear through its contact with the risers and their main buoyancy members due to semi-submersible heave. Bending is induced into the risers due to semi-submersible pitch, roll displacements and surge and sway excursions.

U.S. Pat. No. 3,601,075 discloses a system for riser support and guidance within a weathervaning hull. A guide decouples hull heave from riser tension by guiding the riser within a sleeve having rollers with horizontal axes. The system is pendular and allows angular deflection of the riser upon hull excursion through rotation on a spherical bearing or gimbals. The riser includes a buoyant element, but tensioning is accomplished by a hydraulic draw works. Mechanical means maintain the tower and draw works in a vertical position, and the guides act directly on the riser rather than on the riser buoy. The buoy allows bending to occur in the riser, because the buoy is not guided within a framework, so the riser bends when the riser is not vertical.

French patent publication 2,574,367 shows a variety of drilling production and storage platforms which include a central TLP moored-core buoyant structure surrounded by a hull capable of production and storage. The surrounding hull is free to heave up and down on the Tension Leg Pylon or free to heave and rotate on the Tension Leg Pylon or constrained by its own Tension Leg Moorings. Drilling rig and production equipment are disclosed as being placed on the TLP core. The French patent discloses a floating platform with tension leg means for station keeping.

U.S. Pat. No. 6,161,620 shows a riser can which accepts sliding on the surface of the can, rather than on a riser stem.

U.S. Patent Publication 6,176,646 B1 shows a riser arranged pendularly within the riser can. The riser can has an open bottom and an arrangement which allows riser flexing without over bending at the bottom of the riser can through supports which guide the riser, thereby limiting its minimum bend radius due to spar pitch, roll, surge and/or sway.

U.S. Pat. No. 4,702,321 shows a spar with individual flotation buoys attached for tensioning the top ends of each individual riser connected to the sea floor. The patent shows guides for handling the relative motion between the floating structure and each sea floor fixed riser. Stems above and/or below the buoys are described which cooperate with penetrations in the decks to control the relative position of the riser axis while suffering the relative motion of the floating structure.

Because the guides are connected directly to the platform hull, any hull pitch, roll, surge or sway motion is directly transferred to the risers through those guides. Furthermore, all heave motion of the hull is taken at the interface between the hull and the riser stems.

Prior art buoyancy cans for risers are also known that have flatbars welded to their sides which may be designed as sacrificial members to protect the integrity of the buoyancy cans due to their inherent obligation to withstand all relative motion at that interface.

IDENTIFICATION OF OBJECTS OF THE INVENTION

A primary object of the invention is to provide an improved arrangement for decoupling heave, pitch, and roll motions between a floating offshore platform and risers. The object is to provide an arrangement for supporting subsea risers which is applicable to semi-submersible, SPAR, TLP and FPSO platforms and can be installed within a moonpool or turret thereof.

Another object of the invention is to provide a riser support arrangement for a floating offshore platform that provides pendular support between the risers and a surrounding hull, to allow the risers to tilt in a pendular manner in response to lower frequency surge and sway excursion motions.

Another object of the invention is to provide individual riser buoyancy modules installed in a floating framework which is attached to the sea floor through either a drilling riser or a tendon with a drilling rig installed on the floating framework.

Another object of the invention is to provide an arrangement for centering a floating framework within a centerwell of the platform which includes link arms between the floating framework and the platform.

Another object of the invention is to provide a floating framework and platform arrangement where flotation elements of the framework are completely submerged so that no waterplane area exists in order to exert a constant buoyant force on the framework.

Another object of the invention is to provide a floating framework and a platform hull arrangement that provides individual riser buoyancy, a draw works decoupled from hull motion of the platform, and decoupling of hull motion from the risers so as to eliminate cyclical bending of the risers.

Another object of the invention is to provide a floating framework and a platform hull arrangement characterized by decoupling of the risers from hull pitch and constant riser tension regardless of hull motion, thereby avoiding cyclical tension of the risers.

Another object of the invention is to provide individual riser floating framework that is centered within a platform hull arrangement where the floating framework does not have significant variation in tension due to wave action and hull excursion.

Another object of the invention is to provide a floating framework within a platform hull where a drilling rig is mounted to the floating framework so that it does not require heave compensation and does not induce bending due to the elimination of relative pitch between the surrounding hull and riser support buoy.

Another object of the invention is to provide a floating framework within a platform hull where the floating framework with riser support buoyancy modules is completely submerged, with the result that tension load fluctuations are minimized.

Another object of the invention is to provide a floating framework within a platform hull where protection is provided to the riser support module, and the draw works of a drilling rig is mounted on that module to decouple heave, pitch and roll from the risers and the module supports each riser through individual buoyancy devices.

Another object of the invention is to provide a floating framework within a platform hull where vertical risers are supported from the framework with allowance for individual expansion and angularity as a bundle, where risers are decoupled from hull heave and pitch, where the draw works is mounted on the protective guide frame, and where a tendon is moveable to maintain a constant height of the framework above the sea floor.

Another object of the invention is to provide a floating frame within a platform hull where the frame is buoyant and tethered to the sea floor, has a draw works mounted on it, provides pendular coupling between frame and hull so as to avoid inducing bending of risers carried by the frame and positions the risers within a central vertical opening of the protective hull.

Another object of the invention is to provide a floating frame pendularly coupled to a platform hull with guided buoyancy dividers within the frame for tensioning of multiple risers, and with a drilling rig mounted on the floating frame.

Another object of the invention is to provide a floating frame within a platform hull with an arrangement which allows for independent variation in riser length, with process equipment mounted on the hull and with a buoyant frame tethered to the sea floor by a tendon, but with station keeping of the arrangement accomplished with conventional mooring of the hull.

Another object of the invention is to provide a floating frame within a platform hull with a riser can arrangement pendularly coupled to the hull.

SUMMARY OF THE INVENTION

A floating offshore arrangement substantially decouples pitch, roll and heave motions between an outer hull structure and buoyantly supported risers which are vertically oriented by a frame or support buoy positioned within the interior of the hull structure. The risers are arranged and designed to slide vertically with respect to the support buoy. The support buoy is coupled to the outer hull structure by a mechanism that allows it to remain in a nearly vertical orientation at a fixed distance above the sea floor while the outer hull is free to heave, roll and pitch. The support buoy is allowed to rotate in a pendular fashion in response to the angularity of risers produced by outer hull excursions in surge and sway.

BRIEF DESCRIPTION OF THE DRAWINGS

FIG. 8 illustrates a slidable coupling arrangement between an individual buoyancy can and a support structure;

FIG. 9 is a cross section looking downward along lines 9—9 of FIG. 8 showing how the support structure serves as guidance for the buoyancy can;

FIG. 10 illustrates an alternative coupling arrangement for a square buoyancy can;

FIG. 11 is a cross section of FIG. 10 looking downward along lines 11—11 showing how the sliding shoes couple to the corners of the square buoyancy cans;

FIG. 12 illustrates another slidable coupling between an individual buoyancy can and a support structure;

FIG. 13 is a cross section of FIG. 12 looking downward along lines 13—13 showing a channel track/sliding shoe interface;

FIG. 14 is an alternative arrangement for square buoyancy cans using corner reinforcement devices; and FIG. 15 is a cross section of FIG. 14 looking downward along lines 15—15 showing the arrangement of the comer reinforcement devices.

DESCRIPTION OF THE INVENTION

Figure 1:
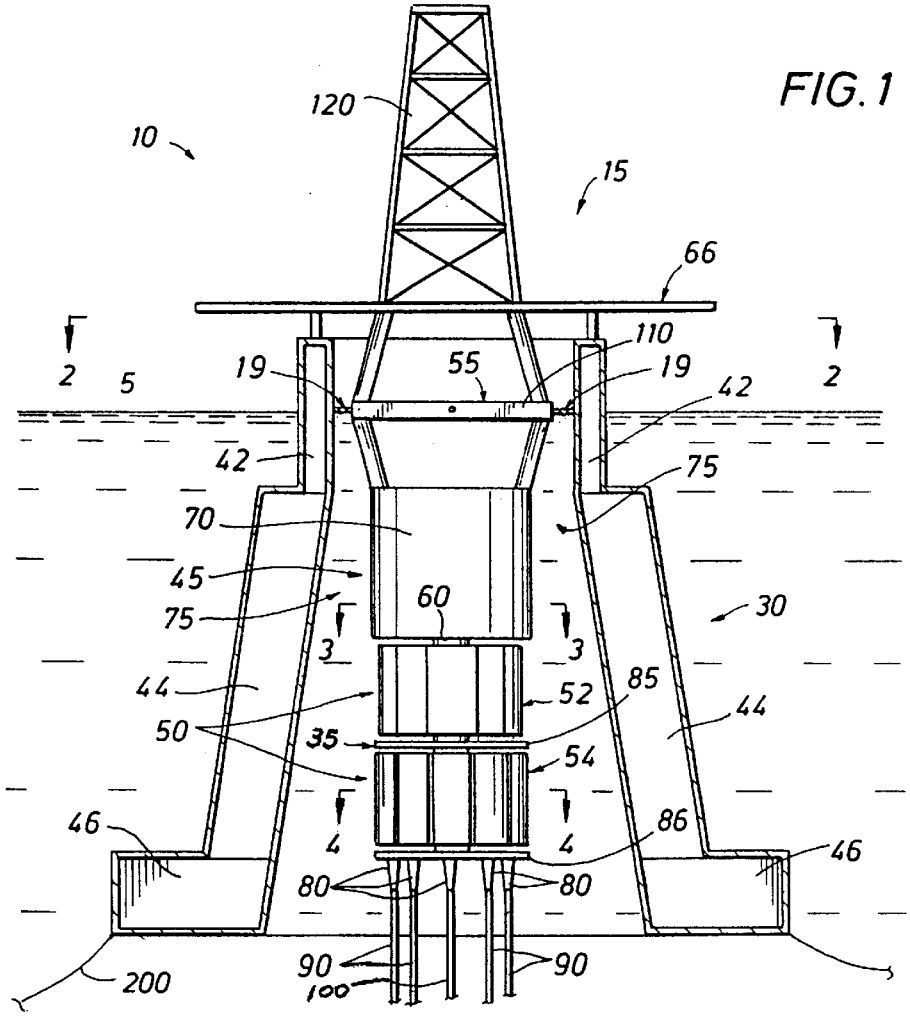
FIG. 1 illustrates the invention in a first embodiment of an offshore platform showing an inner structure pendularly centered inside an outer hull structure.

FIG. 1 illustrates the invention in an embodiment of a floating offshore platform 10. In this embodiment, the floating offshore platform 10 includes an inner structure 15 and an outer hull structure 30. The inner structure 15 includes a riser guide structure 35 and a support buoy structure 45 with a drilling draw works 120 mounted thereon.

The riser guide structure 35 is fixed with respect to the sea floor by means of at least one riser or tension member. A support buoy structure 45 is fixedly coupled to the riser guide structure 35. The outer hull structure 30 is coupled to the support buoy structure 45 by a connection mechanism 55. The heave, pitch and roll motions acting on the outer hull structure 30 are decoupled from inner structure 15 (riser guide structure 35 and support buoy structure 45) by means of the connection mechanism 55. Transfer of the heave forces on the buoy structure 45 to the riser guide structure 35 is reduced, if not completely eliminated, by means of the tethered connection to the sea floor of the riser guide structure 35 and the fact that the buoy structure 45 is free to slide vertically with respect to the risers which are independently supported by one buoyancy module per riser. As a result, heave, pitch, and roll motions all are effectively decoupled from the risers 90 and their buoyancy modules 50.

Figure 1A:
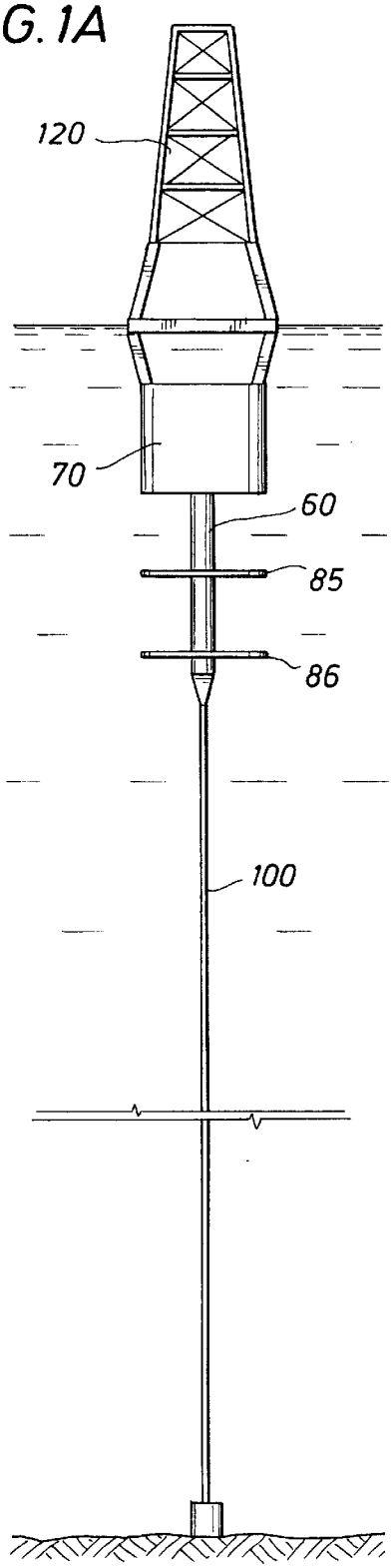
FIG. 1A shows a framework for an inner structure of FIG. 1 with a support buoy and drilling works mounted thereon and with a central shaft tethered to the sea floor and with riser guides mounted thereon.

In other words, the hull 30 is free to move in pitch, roll and heave without such pitch, roll and heave movements being transferred to the inner structure 15, because of the connection mechanism 55, and because support buoy structure 45 (on which drilling rig equipment 120 is mounted) and riser guide structure 35 are fixedly connected to one another and tethered to the sea floor preferably by a central tether member 100 as shown in FIGS. 1 and 1A. (Other tethering arrangements may be provided as described below.) The inner structure 15 (including riser guide structure 35 and support buoy structure 45) is free to translate due to surge forces of the hull structure 30 being transferred to the inner structure 15, via connection mechanism 55. Such translation causes risers 90 to pivot from their tethered connection to the sea floor. When the risers pivot, the risers 90 coupled to buoyancy modules 50 are free to slide vertically within lateral guides 85 and 86 of riser guide structure 35.

The outer hull structure 30 includes an upper hull 42, a middle hull 44, and a lower hull 46. The offshore platform 10 can take alternative forms. For example, the exterior shape of the outer hull structure may be a Tension Leg Platform (TLP), a SPAR (e.g., cylindrical shape), or FPSO or FSO ship shape. Its internal shape is preferably conical (as illustrated in FIG. 1) to allow the support structure 45 to pivot with respect to the tethering point on the sea floor (see FIG. 1D) when the hull 30 translates from its stable position due to sea surge and/or sway forces. One of the primary effects of the shape of the outer hull structure 30 is to protect the inner structure 15 from environmental effects such as wind and waves. In the embodiment of FIG. 1, the outer hull structure 30 circumferentially surrounds the inner structure 15 with the inner structure 15 being pendularly centered inside the outer hull structure 30. Preferably, the lower hull 46 is at such a depth that the majority of sea forces hit the outer hull structure 30 while protecting the inner structure 15 from such radial sea forces. As shown in FIG. 1, the lower hull section 46 extends horizontally (outwardly) serving to suppress motions in response to vertical sea forces (heaving). The middle hull section 44 slants at an angle (that is, it is conically shaped) such that pitching motions of the outer hull 44 do not cause the hull 44 to contact the buoy structure 45 or riser support structure 35. Preferably, the outer hull structure 30 is buoyant; and, if desired, the outer hull structure 30 can be ballasted and deballasted by any means known in the art. The hull as mentioned previously may be a SPAR, TLP or ship shaped hull. Its station keeping may be provided through catenary, inverted catenary, taut, semi-taut or other conventional means or through tension legs or dynamic positioning. In the event the hull 30 is allowed to weathervane, its interior conical structure would be provided by the geostationary portion of a traditional single point mooring turret allowing its connected FPSO hull to weathervane about the buoy and geostationary turret. Additionally, a production deck 66, as known in the art of hydrocarbon production and storage, is mounted (if desired) to the upper hull section 42. The outer hull structure 30 may be conventionally moored to the sea floor, e.g. by anchor legs 200 as shown in FIG. 1. As mentioned above, dynamic positioning or tension legs could be used alternatively to anchor legs. Such mooring of the outer hull structure decreases or eliminates the need for complete reliance on the mooring connection of the riser structure 35, illustrated below. The interior conical structure of moonpool 75 may be an opening in a TLP, SPAR or ship shaped hull.

Figure 2:
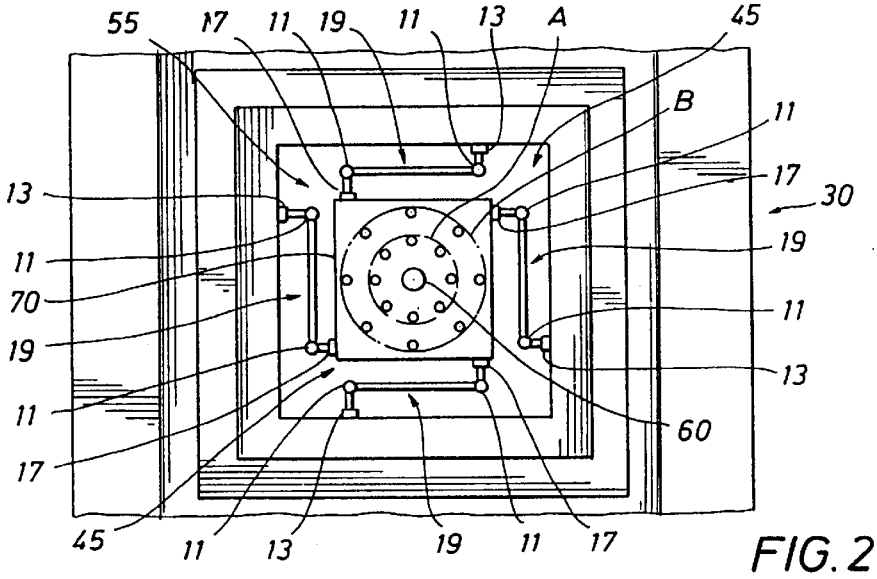
FIG. 2 is a cross section of FIG. 1 looking downward along lines 2—2 showing the details of a connection mechanism which decouples motions of the outer hull structure from acting on the inner structure.

The outer hull 30 is coupled to the inner structure 15 via the support buoy 45 by means of a passive, permanent connection mechanism 55. Such connection mechanism is designed and arranged to allow the support buoy 45 to pivot about two horizontal axes with respect to hull 30 simultaneously. In other words, pendular coupling between support buoy 45 and hull member 42 is preferred. A preferred arrangement of the passive linkage and non-disconnectable connection mechanism 55 includes four legs or link arms 19 as seen in FIG. 2. The connection mechanism 55, which is permanently connected between outer hull 30 and inner structure 15, substantially isolates motions of the hull section 42 in pitch and roll from the vertically oriented buoy 45 and simultaneously isolates heave motions of the hull section 42 from the support buoy 45. This is accomplished by an arrangement of pinned flex arms 19 arranged as illustrated in FIG. 2. The arms 19 centralize the buoy 45 within moonpool 75 inside the outer hull structure 30 and hull section 42. Because the pinned link arms 19 can pivot at their connections 17, 13 to the buoy 45 and the hull section 42 and can flex as a result of spherical bushings 1, heave, pitch and roll motions acting on the outer hull structure 30 are decoupled from acting on the buoy 45 and inner structure 15.

Figure 1B:
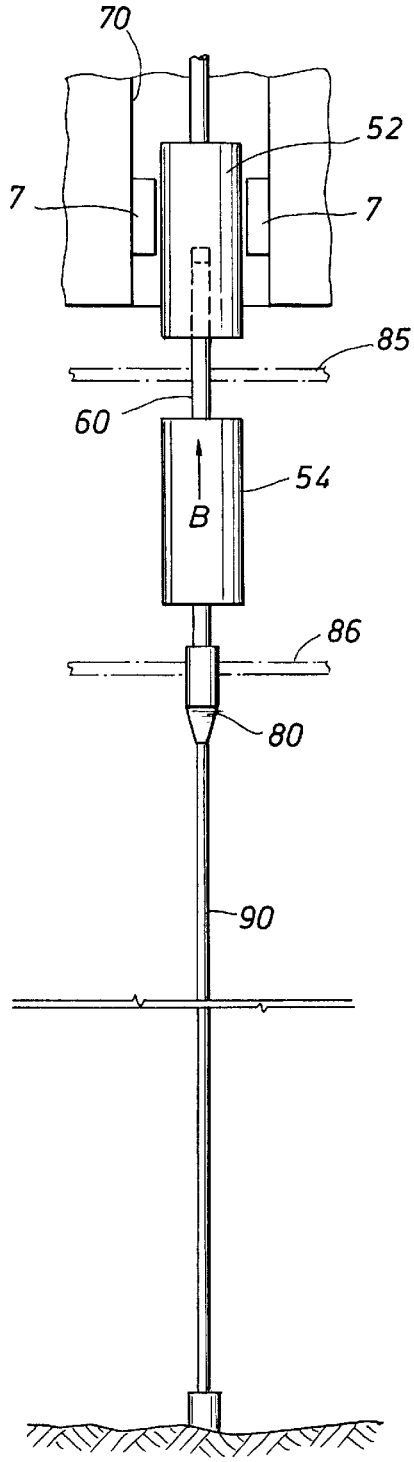
FIG. 1B illustrates buoyancy cans mounted on a riser which is guided by upper and lower guides.

The riser guide structure 35 guides individual risers 90 by means of individual floats 50 and riser guides 85 and 86. As noted above, the riser structure 35 is vertically oriented and tethered to the sea floor, preferably by a central tether 100 which may be a riser or other type of tension member. The tether can be a riser, tendon, wire rope, chain, poly rope or combination thereof. The tether arrangement, whether it be by risers, tendons, chain or wire rope, etc., maintains the riser structure at a fixed distance above the sea floor and provides stability to the structure 15. Risers 90 carry hydrocarbon fluids up to the riser structure 35 and through the support buoy structure 45 to the production deck 66. While not shown in this embodiment, a drilling riser could also be used during drilling or workover operations through central shaft 60 or risers 90. Production risers 90 are held in tension by means of individual riser floats 50 connected thereto. In the arrangement of FIG. 1, because individual riser floats 50 are used, independent expansion or contraction of the risers 90 can occur in each riser, because space exists above and below float 50, with respect to buoy 70 bottom and guide platforms 85 or 86 as seen in FIG. 1B.

Preferably, the individual riser floats 54, 52 are completely submerged beneath sea surface 5, causing the upward buoyant force of the individual riser floats to remain approximately constant. The individual riser floats as shown in FIGS. 1 and 1B include an upper set of individual riser floats 52 and a lower set of individual riser floats 54. Both sets of riser floats 52 and 54 are arranged around a central tubular shaft 60 as seen in FIG. 4.

Figures 1C, 1D:
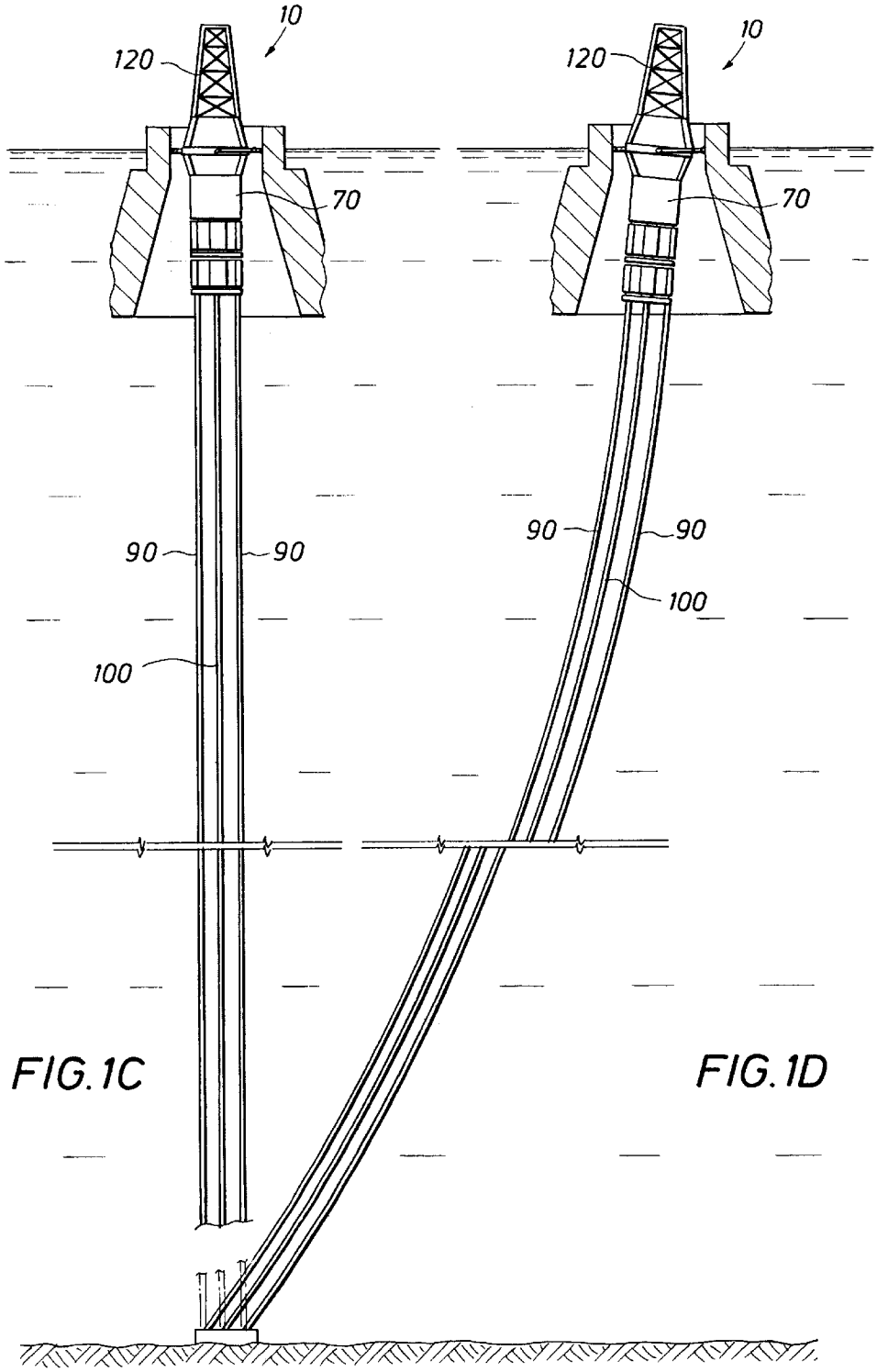
FIGS. 1C and 1D illustrate the orientation of the outer hull and the inner structure under a calm vertical condition (FIG. 1C) and under a surge and/or sway angularly displaced position (FIG. 1D)
Figure 3:
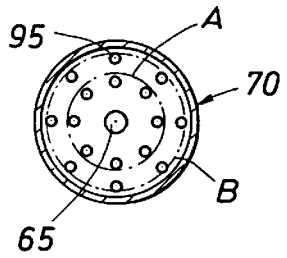
FIG. 3 is a cross section of FIG. 1 looking downward along lines 3—3 showing the support buoy with riser openings and a central opening for a central column.
Figure 4:
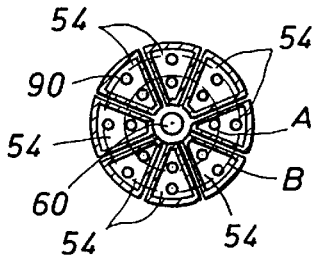
FIG. 4 is a cross section of FIG. 1 looking downward along lines 4—4 showing the arrangement of individual risers floats around a central column.

In the arrangement of FIG. 1, there are two concentric rings of risers 90 around central tubular shaft 60 as seen in FIGS. 2, 3 and 4. An inner ring A is placed around central tubular shaft 60. Inner ring A risers are individually, connected to riser buoyant members or cans 54 while each riser of ring B is connected to an individual riser buoyant member or can 52 above guide 85. See FIG. 1B. The riser guides 85, 86 and the central tubular shaft 60 provide a framework for the individual cans 50 (54 and 52) in guiding the risers 90 up and through the support buoy 70. Each riser is free to slide on interior guides 85, 86 and support buoy 70. Flexible conductors (not shown) may be provided from the upper ends of the risers 90 to the production deck 66 mounted on the inner section 42 of hull 30. Additionally, the riser guides 85, 86 are arranged to keep the risers 90 radially separated from each other, but they allow for any angularity or tilting of the risers 90 to occur as a bundle as illustrated in FIG. 1D. Coupled to riser stems 90 of buoyancy modules 50 are stress joints 80. The column 60, if desired, can be arranged to allow a workover drill string or drilling bit to pass through its center to allow simultaneous drilling and production. Other equipment such as drill string risers (not shown) can be used for workover operations.

As described above, FIG. 1 shows a derrick 120 mounted on the support buoy 70. Heave, pitch and roll motions acting on the outer structure 30 are decoupled from the support buoy 70, because it is part of the inner structure 15. As a result, workover operations can occur on this offshore platform 10. Because there is no relative heave, pitch or roll motions between a drill string (not shown) of derrick 120 extending down through the column 60, and support buoy 70, drilling can be accomplished even when the outer hull structure 30 is heaving, pitching and rolling with minimal need for derrick heave compensation.

FIG. 3 is a cross section through support buoy 70 looking downward along lines 3—3 of FIG. 1. When the offshore platform hull 30 moves in heave, it moves up and down with respect to support buoy 70. The risers 90 and buoyant modules or cans 50 are independent in heave of the riser structure 35 including central tubular shaft 60, and riser guides 86, 85. The buoy 70 is free to move vertically relative to the risers 90 and the buoyancy modules 50 (e.g., buoyancy cans 52, 54). As illustrated in FIG. 3, riser openings 95 are provided in the support buoy 70 to accept risers. The tubular shaft 60 is welded to buoy structure 70 thereby creating opening 65. If the support buoy 70 moves vertically, the risers 90 slide within openings 95, and the tubular shaft 60 (which is connected to riser guides 86, 85) allow the risers 90 and buoyancy cans 50 to remain fixed relative to the sea floor with no loads exerted thereon. If desired, the riser openings 95 can be lined with material to facilitate the sliding. In a more complex embodiment, bearing surfaces can be attached to the sides of risers 90 or to the sides of riser openings 95 or both. A material with a low coefficient of friction can be used. Alternative embodiments of a slidable connection are shown in FIGS. 8–11.

FIG. 1A illustrates the connection between the support buoy 70 and the upper guide 85 and lower guide 86 with central tubular shaft 60. The tubular shaft 60 is tethered to the sea floor by tether 100. The support buoy 70 provides net upward force or tension to tether 100. The couple created between the upward buoyancy provided by support buoy hull 70 and the downward tension in tether 100 makes the inner structure 15 statically stable.

FIG. 1B illustrates that each riser 90 includes a buoyancy module or cans, either 54 or 52 with the upper buoyancy module 52 guided by guide walls 7 within the support buoy 70 or guided on their stems at openings 95 and at 85 or at 85 and 86. The buoyancy modules 54 and 52 provide upward buoyant force to maintain each riser in approximately constant tension.

FIG. 1C illustrates the offshore platform 10 under calm conditions where the tether 100 is substantially vertical with respect to its sea floor tethering point, and FIG. 1D illustrates the platform 10 where surge forces force the platform laterally from its vertical stable point. Risers 90 are free to expand or contract in length with respect to support member 70 due to internal pressure or temperature changes. FIG. 1D is an exaggerated illustration of the displacement of the offshore platform 10 when surge and/or sway forces cause the support buoy 70 to be displaced from calm vertical conditions of FIG. 1C. As illustrated in FIG. 1D, the drilling rig draw works 120 remains aligned with support buoy 70. No bending stresses are imparted to risers 90, because tether 100 urges buoy 70 in a pendular fashion from the sea floor.

Figure 5:
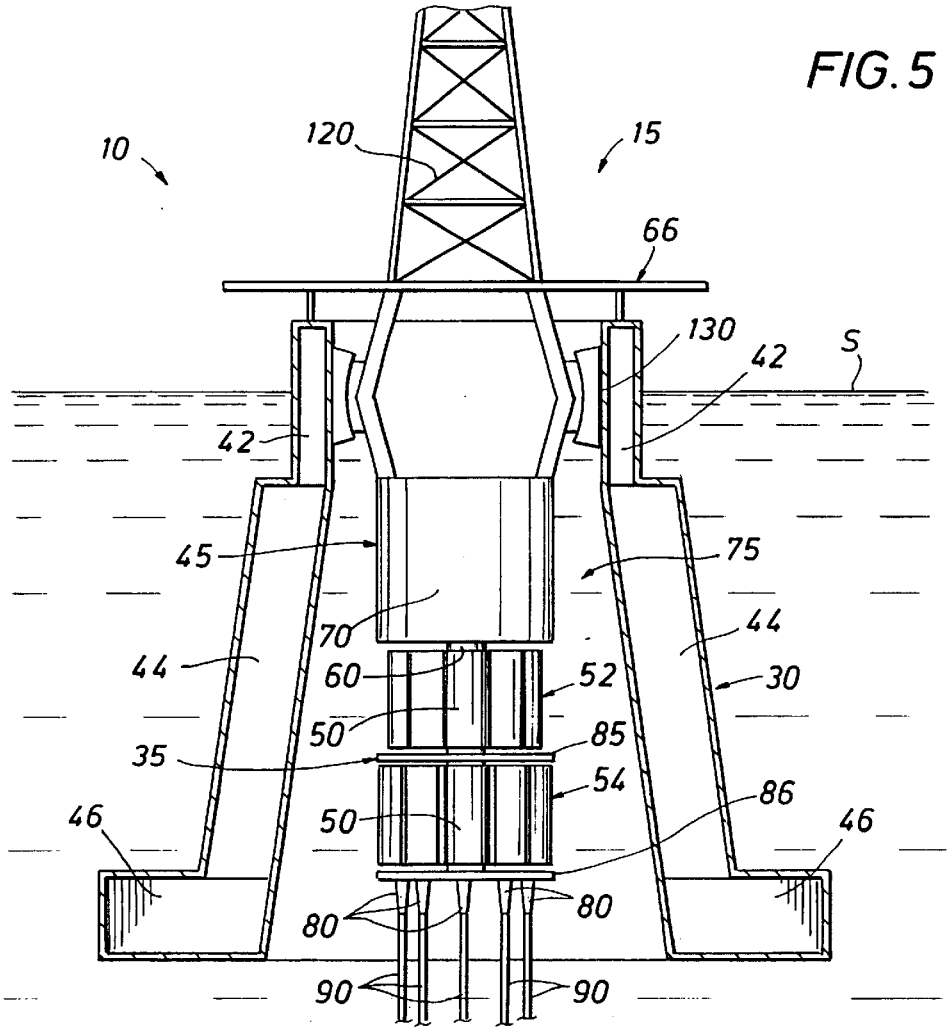
FIG. 5 illustrates the invention in another embodiment of an offshore platform showing an alternative connection mechanism.

FIG. 5 is an illustration of the invention in an alternative embodiment. The floating offshore platform 10 is similar to that of FIG. 1 except that sliding bearings 130 are substituted for the connection mechanism 55 of FIG. 1. In a similar manner to the link arms 19 and pins 13, 17 of FIG. 2, sliding bearings 130 are arranged and designed to allow the outer hull structure 30 to heave, pitch and roll with respect to the inner structure 15 in response to sea forces. Preferably, four sliding bearings 130 are provided, two for pitch motions and two for roll motions, all acting together for heave motions. The floating platform 10 is free to heave, pitch and roll with respect to the support buoy 70 without causing such motions in the support buoy.

Figure 6:
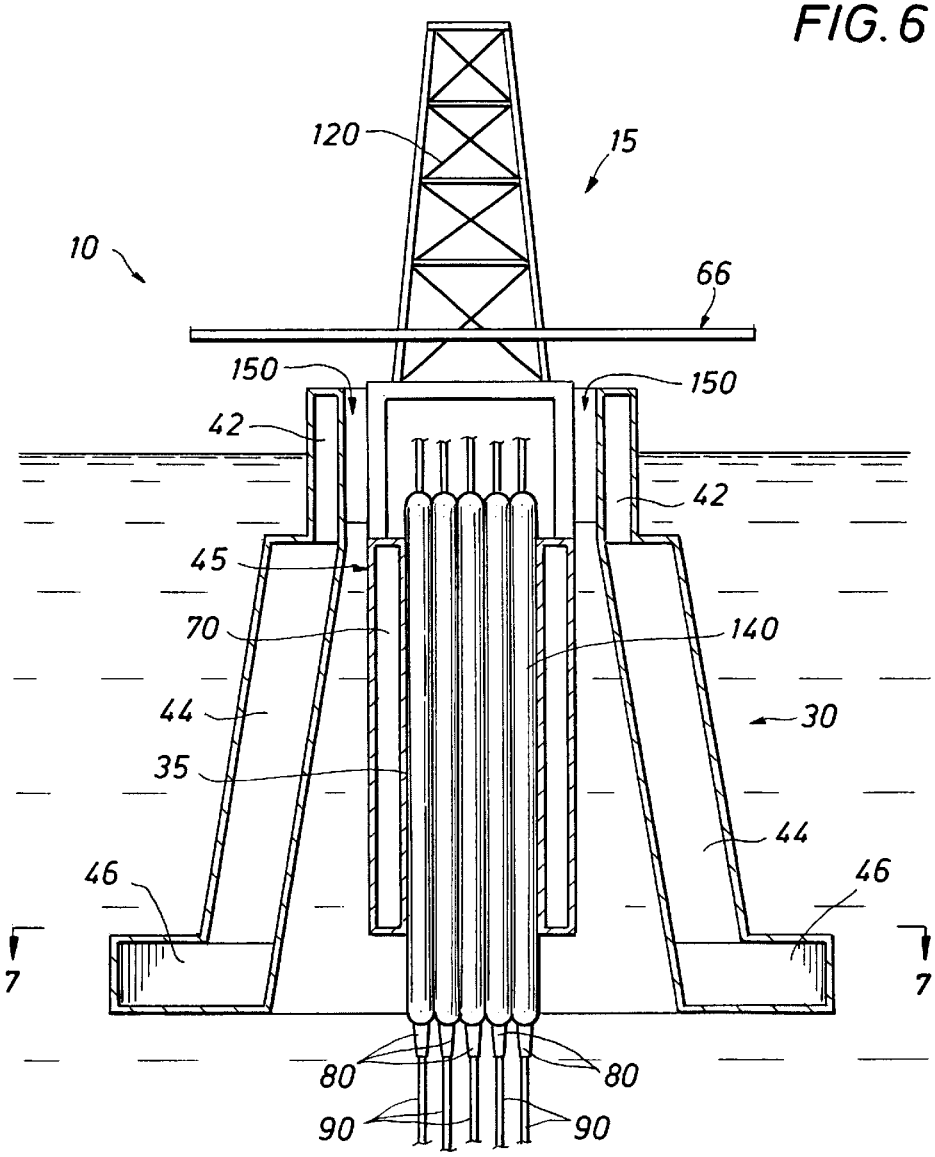
FIG. 6 illustrates the invention in another embodiment of an offshore platform with riser support provided by individual cylindrical buoyancy cans.
Figure 7:
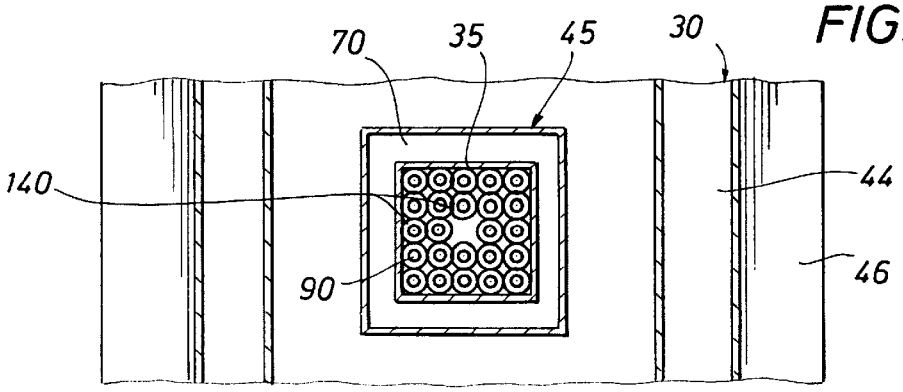
FIG. 7 is a cross-section looking downward along lines 7—7 of FIG. 6 showing the arrangement of the cylindrical buoyancy cans.

FIGS. 6 and 7 illustrate another alternative embodiment of the invention. The offshore platform 10 works in the same manner as that of FIGS. 1 and 5 except that buoyancy cans of the risers are provided via individual cylindrical buoyancy cans 140. As in FIGS. 1 and 5, the support buoy 70 tethered to the sea floor is free to slide relative to the individual buoyancy cans 140. At space 150, a connection mechanism can be provided to decouple heave and pitch and roll motions of the outer hull 30 from the inner structure 15. Such connection mechanism can be link arms and pins as illustrated in FIG. 1 or sliding bearings as illustrated in FIG. 5, or any equivalent device known in the art. Preferably, the connection mechanism is designed to isolate the outer hull in heave, pitch and roll from the support buoy 70.

FIG. 7 is a cross-section looking: downward along lines 7—7 of FIG. 6. It shows the arrangement of the individual buoyancy cans 140. In the embodiment of FIG. 7, 25 cans are provided—arranged 5 by 5 in a square. The central can is removed to provide tethering to the sea floor. As in FIGS. 1 and 5, the support buoy 70 is capable of sliding relative to the individual buoyancy cans 140. Arrangements to facilitate this sliding include bearing surfaces of materials with low coefficients of friction and the like. Two alternative embodiments of a slidable connection are shown: a first in FIGS. 8 and 9; a second in FIGS. 10 and 11.

FIG. 8 shows an embodiment of a slidable coupling between an individual buoyancy can 160 and a support structure 180. The support structure 180 can be a portion of the support buoy structure 70 (FIGS. 1, 2, 3, 5, 6, and 7) and can serve as a guidance for the buoyancy can 160. In this arrangement, an individual riser 90 is coupled to its individual buoyancy can 160. The individual buoyancy can 160 contains a plurality of sliding shoes 170 located peripherally thereon. The sliding shoes 170 slidably couple with an inner wall 185 of the support structure 180. This slidable coupling via the sliding shoes 170—inner wall 185 interface can prevent contact between the individual buoyancy can 160 and the support structure 180. The sliding shoes 170 can be coupled to the individual buoyancy can 160 through any means known to those skilled in the art. The sliding shoes 170 and the inner wall 185 are preferably made of a material with a low coefficient of friction—allowing the support structure 180 to move relative to the individual buoyancy can 160. In an alternative embodiment, the sliding shoes 170 could be coupled to the support structure 180 with the sliding occurring between the sliding shoe 170 and the individual buoyancy can 160. Alternatively, the sliding shoes 170 can be coupled directly to the riser 90 facilitating sliding such as that in FIG. 1. As can be seen with the arrangement of FIG. 8, the sliding shoes 170 and individual buoyancy can 160 do not always have to be in contact, but can be arranged and designed to do so, if desired.

FIG. 9 is a cross section looking downward along lines 9—9 of FIG. 8. The support structure 180 serves as guidance for the individual buoyancy can 160. While the embodiments of FIGS. 8 and 9 show the support structure 180 as being substantially square, alternative shapes could be used including rectangular, circular, triangular, and the like.

FIG. 10 is an alternative slidable coupling arrangement for a square individual buoyancy can 160 in a square support structure 180. The arrangement operates in a similar manner to that of FIGS. 8 and 9, except that the sliding shoes 170 have been moved to the comers of the square individual buoyancy can 160. This arrangement allows for more buoyancy per unit length than that of FIG. 8.

FIG. 11 is a cross section of FIG. 10 looking downward along lines 11—11. This cross section shows how the sliding shoes 170 couple to the corners of square individual buoyancy can 160, and how the sliding shoes 170 couple with the comers of the inner wall 185.

FIG. 12 is another embodiment of a slidable coupling between an individual buoyancy can 160 and a support structure 180. In this embodiment, the individual buoyancy can 160 has a plurality of channel tracks 190 provided on its periphery. The support structure 180 has a plurality of sliding shoes 170 coupled to the inner wall 185. The channel tracks 190 and sliding shoes 170 are adapted to couple with one another creating a slidable connection between the support structure 180 and the individual buoyancy can 160. Additionally, the channel tracks 190/sliding shoes 170 interface can create a guide for the individual buoyancy can in the support structure 180. The channel tracks 190/sliding shoes 170 interface can be done in a variety of ways, which should be become apparent to those skilled in the art. The embodiment of FIG. 8 provides sliding shoes 170 that are complimentary to the channel tracks 190. The channel track 190 at arrow 200 is cutout to show the channel track 190/sliding shoes 170 interface. While this embodiment provides the sliding shoes 170 on the inner wall 185 and the channel tracks 190 on the individual buoyancy can 160, in an alternative embodiment, the channel tracks 190 could be on the inner wall 185 and the sliding shoes 170 could be on the individual buoyancy can 160. Additionally, in an alternative embodiment, the support structure 180 can be a different shape such as a circle, triangle, or the like.

FIG. 13 is a cross section of FIG. 12 looking downward along lines 13—13. This figure illustrates how the channel tracks 190 and sliding shoes 170 can interface with one another.

FIG. 14 is an alternative embodiment of FIGS. 12 and 13 showing a square buoyancy can 160 slidably coupled inside a square support structure 180. FIG. 14 works in a similar manner to that of FIGS. 12 and 13, except that comer reinforcements 210 are used instead of channel tracks 190. As can be seen in this embodiment, sliding shoes 170 are provided on the square individual buoyancy can 160. The support structure 180 contains corner reinforcements 210, which are adapted to compliment the sliding shoes 170.

FIG. 15 is a cross section of FIG. 14 looking downward along lines 15—15. This cross section shows the corner arrangement of the corner reinforcements 210 and sliding shoes 170.

It should be understood that the invention is not limited to the exact details of construction, operation, or embodiments shown and described, as obvious modifications and equivalents will be apparent to one skilled in the art. For example, while the offshore platform 10 is designed to decouple heave, pitch, and roll motions of a hull from acting on risers 90, the offshore platform 10 does not necessarily completely isolate such motions from the risers 90. The offshore platform 10 can be used to reduce such motions from acting on the risers 90.

Also, the outer hull structure 30 can be made of any material and by any means known to those skilled in the art. While in a preferred embodiment, the lower hull 44 extends horizontally outward, such may not be the case in other embodiments. Additionally, the outer hull structure 30, if buoyant, can be ballasted by any means known to those skilled in the art. The hull 30 can provide storage or produced fluids. Furthermore, while in a preferred embodiment the outer hull structure 30 is tethered to the sea floor using mooring lines, in other embodiments, the hull can be kept in position using dynamic positioning and the like.

While the production deck 66 is preferably mounted to the outer hull structure 30, other embodiments could mount the production deck 66 to either the support buoy structure 45 or the riser structure 35, both part of the inner structure 15. Still in other embodiments, a production deck 66 might not be needed.

The connection mechanism 55, referenced in the preferred embodiments, can be one of many choices for decoupling heave, pitch and roll motions from acting on the inner structure 15. These choices include, but are not limited to joints, bearing surfaces, spherical bushings, link arms, and the like. Additionally, while a single device is illustrated for each of the embodiments of FIGS. 1 and 5, a plurality of devices working together to decouple heave, pitch and roll motions could be used. For example, one device could be used to decouple the pitch motions and another could be used to decouple the roll motions.

With regard to a buoyant device, which provides tension to the risers 90, two embodiments are shown: the individual riser floats 50 (see floats 54 of FIG. 4, which each provide a single buoyancy module for its riser) and individual buoyancy cans 140 (FIGS. 6 and 7) and 160 (FIGS. 8–15) (which provide a singled buoyancy can for each riser). However, other arrangements and devices that provide buoyant uplift, as known in the art, can be used. Additionally, the support structures used to support these buoyant devices, as known in the art, can be provided. Two embodiments are given with reference to FIGS. 1, 5, and 6. However, such structures can include, but are not limited to the embodiments of the structures disclosed with reference to FIGS. 8–15. While the preferred embodiment describes the buoyant device as a plurality of individual riser floats 50 and a plurality of individual buoyancy cans 140, other embodiments may contain a single riser float or single buoyancy can 140. Accordingly, the invention is therefore limited only by the scope of the claims.

What is claimed:

1. A floating offshore platform comprising:

an inner structure, including at least one riser and a support buoy, wherein said support buoy is tethered to a sea floor tether point by a tether with a tether connection connected along a longitudinal center line of said support buoy and said support buoy supports said at least one riser generally in a vertical orientation;

an outer hull structure, circumferentially surrounding said support buoy and moored with respect to the sea floor independently of said inner structure;

a connection mechanism disposed between said inner structure and said outer structure, wherein said connection mechanism substantially decouples heave, pitch and roll motions acting on said outer hull structure from acting on said inner structure, and said tether and tether connection allows said inner structure to incline to accommodate relative angles between said inner structure and said sea floor tether point induced by hull, surge, or sway excursions thereby minimizing riser bending at said support buoy.

2. The floating offshore platform of claim 1, wherein, at least one buoyant device is coupled to said at least one riser, and a slidable coupling is positioned between said at least one riser and said support buoy, whereby heaving, pitching and rolling motions acting on said outer hull structure are substantially decoupled from said riser.

3. The offshore platform of claim 2, wherein said buoyancy device is completely submerged when said offshore platform is in operation.

4. The floating offshore platform of claim 1, wherein said inner structure includes a drilling draw works mounted on said support buoy.

5. The floating offshore platform of claim 4, wherein said drilling draw works includes a derrick for drilling equipment.

6. An offshore platform comprising:

an inner structure tethered to the sea floor comprising a riser structure including at least one riser arranged and designed for connection to a sea floor and a buoyant device creating tension on said riser, and a support buoy structure slidably coupled to said riser structure by a slidable coupling;

an outer hull structure moored to the sea floor independently of said inner structure and which circumferentially surrounds said inner structure, and a passive, non-disconnectable connection mechanism between said outer hull structure and said support buoy structure which substantially decouples heave, pitch and roll forces which act on said outer hull structure from being transferred to said inner structure.

7. The offshore platform of claim 6, further comprising a deck coupled to said outer hull structure.

8. The offshore platform of claim 6, wherein said connection mechanism includes link arms connected between said support buoy and said outer hull structure by pivot connections and spherical bushings.

9. The offshore platform of claim 6, wherein said connection mechanism includes sliding bearings.

10. The offshore platform of claim 6, wherein said slidable coupling includes a sliding shoe which is positioned between said at least one buoyant device and said support buoy structure.

11. The offshore platform of claim 6 wherein, said support buoy structure is tethered to said sea floor by a tether connected along a longitudinal center line of said support buoy whereby said inner structure is capable of inclining to accommodate relative angles between said inner structure and said sea floor tether point induced by hull, surge or sway excursions thereby minimizing bending of said at least one riser at said support buoy structure.

12. A method of decoupling motions acting on a riser structure, comprising the steps of:

centering a floating inner structure which is tethered to the sea floor inside an outer hull structure, wherein said inner structure includes said riser structure, and wherein said riser structure includes at least one riser and at least one buoyant device; and providing a passive, permanent coupling between said outer hull structure and to said inner structure in a manner which decouples heave, pitch and roll motions acting on said outer hull structure from acting on said inner structure wherein, said coupling step is achieved by coupling link arms between said floating inner structure and said outer hull structure via spherical bushings and pivot connections.

13. The method of claim 12 further comprising the step of tethering said floating inner structure to said sea floor by connecting a tether from said sea floor to a point along a longitudinal center line of said buoyant device.

14. A floating offshore platform comprising, an inner structure including at least one riser and a support buoy, wherein said support buoy is tethered to a sea floor tether point and supports said at least one riser generally in a vertical condition; wherein, at least one buoyant device is coupled to said at least one riser, and a slidable coupling is positioned between said at least one riser and said support buoy, an outer hull structure which circumferentially completely surrounds said support buoy and is moored with respect to the sea floor independently of said inner structure, whereby said inner structure is substantially isolated from wave and wind forces of the sea by the outer hull structure; and a passive linking mechanism permanently connected between said inner structure and said outer structure, said linking mechanism being designed and arranged to substantially decouple heave, pitch and roll motions acting on said outer hull structure from acting on said inner structure.

15. The offshore platform of claim 14 wherein a tether is attached at said sea floor tether point and at a point along a longitudinal center line of said support buoy to allow said inner structure to incline to accommodate relative angles between said inner structure and said sea floor tether point induced by hull, surge, or sway excursions.

16. The offshore platform of claim 15 wherein, said linking mechanism is a mechanical assembly including link arms connected between said support buoy and said outer hull structure.

17. A floating offshore platform comprising, an inner structure, including at least one riser and a support buoy, with said support buoy tethered to a sea floor tether point by a tether with a tether connection provided along a longitudinal center line of said support buoy, and with said support buoy supporting said at least one riser generally in a vertical orientation, an outer hull structure, circumferentially surrounding said support buoy and moored with respect to the sea floor independently of said inner structure, and a connection mechanism permanently connected between said inner structure and said outer structure, wherein said connection mechanism substantially decouples heave, pitch and roll motions acting on said outer hull from acting on said inner structure, and said tether connection allows said inner structure to incline to accommodate relative angles between said inner structure and said sea floor tether point induced by hull, surge or sway excursions, and a drilling rig mounted on said support buoy, whereby said drilling rig is substantially isolated from heave, pitch and roll motions of said outer structure.

18. The floating offshore platform of claim 17 wherein, said connection mechanism includes link arms connected between said support buoy and said outer hull structure by pivot connections and spherical bushings.

19. The floating offshore platform of claim 17 wherein, said outer structure includes a frustro conically shaped interior which surrounds said support buoy.

* * * * *